US006648165B1

(12) United States Patent
Accardo

(10) Patent No.: US 6,648,165 B1
(45) Date of Patent: Nov. 18, 2003

(54) DOUBLE BAY CONTAINER AND LINER THEREFOR

(76) Inventor: Carl A. Accardo, W7696 State Road 82, Mauston, WI (US) 53948

( * ) Notice: Subject to any disclaimer, the term of this patent is extended or adjusted under 35 U.S.C. 154(b) by 13 days.

(21) Appl. No.: 09/635,634

(22) Filed: Aug. 10, 2000

(51) Int. Cl.[7] ..... B65D 1/24

(52) U.S. Cl. ..... 220/507; 220/553; 220/495.01; 220/914

(58) Field of Search ..... 220/495.02, 495.01, 220/505, 507, 528, 553, 914

(56) References Cited

U.S. PATENT DOCUMENTS 1,757,475 A * 5/1930 Pratt
2,162,162 A * 6/1939 DeMurguiondo
4,648,524 A * 3/1987 Ackermann ..... 220/507
4,800,845 A * 1/1989 Budd ..... 119/61
4,944,427 A * 7/1990 Yamada et al. ..... 220/406
5,067,761 A 11/1991 Blowers ..... 294/3.5
5,603,428 A 2/1997 Breckwoldt ..... 220/755
5,676,793 A 10/1997 Martin et al. ..... 156/578
5,736,001 A 4/1998 Samuelson ..... 156/575
6,006,936 A * 12/1999 Przybylowicz ..... 220/23.8

* cited by examiner

*Primary Examiner*—Stephen Castellano
(74) *Attorney, Agent, or Firm*—Archie W. Umphlett

(57) ABSTRACT

A container is provided that has two receptacles joined at a common edge and is thereby suitable for resting on the forearm of a user. A liner for the container is provided.

8 Claims, 2 Drawing Sheets

DOUBLE BAY CONTAINER AND LINER THEREFOR

BACKGROUND OF THE INVENTION

This invention relates to containers. More particularly, this invention relates to containers useful for holding joint compound and similar material that can be mixed within the container and scooped therefrom for application with an applicator such as a taping knife or trowel. Even more particularly, this invention relates to double bay containers suitable for retaining in a second bay material spilled over the edge of a first bay as it is scooped therefrom.

Containers for joint compound are well known. Generally, these containers are semi-cylindrica or parallelepiped, elongated troughs with closed ends. They are of a length to accommodate the applicator tool. They are composed of a material that makes them of sufficiently light weight to be held comfortably in one hand while filled with a supply of working material which is being applied with an applicator held in the other hand. This invention addresses Typical of such devices is the container disclosed in U.S. Pat. No. 5,603,428. This open topped container has a single chamber that features an enclosing wall of continuous, smooth curvature that allows the applicator to maintain contact with this wall throughout the action of scooping material from the chamber. The container also features a contoured grip portion on the outside of the container to facilitate maintaining a grip on the loaded container. The grip portion also permits the container to be rested on a surface without tipping over.

Such devices do not provide means by which material can be scooped from the container, scraping the applicator against the upper edge of the container to remove excess material, particularly at the ends of the applicator, without carrying some of the material over the scraping edge. The material carried over the edge is not only is lost to the process but becomes a problem of spilled material. Such devices also tend to excessively tire the hand and arm that support them because the hand is required to clamp the container thereby doing more work than necessary in support and manipulation of the container.

SUMMARY OF THE INVENTION

It is, therefore, an object of this invention to provide a hand-held, double bay container suitable for use in the application of joint compound or similar material. It is another object of this invention to provide means for recovering material within a second bay as it is scooped from a first bay. It is a further object of this invention to provide a double bay container that rests comfortably on the forearm of a user. It is another object of this invention to provide a double bay container that can be rested on a surface without tipping over. It is yet another object of this invention to provide a double bay container ergonomically designed to balance on the forearm and to reduce movement of the wrist thereby reducing fatigue of the user. It is still another object of the invention to provide a liner for a double bay container to thereby facilitate the cleaning of the container.

For the purposes of this invention the article set out in this disclosure will be defined as a "container". The open, holding chambers or "bays" of the container will be defined as "receptacles".

DETAILED DESCRIPTION OF THE INVENTION

Figure 1:
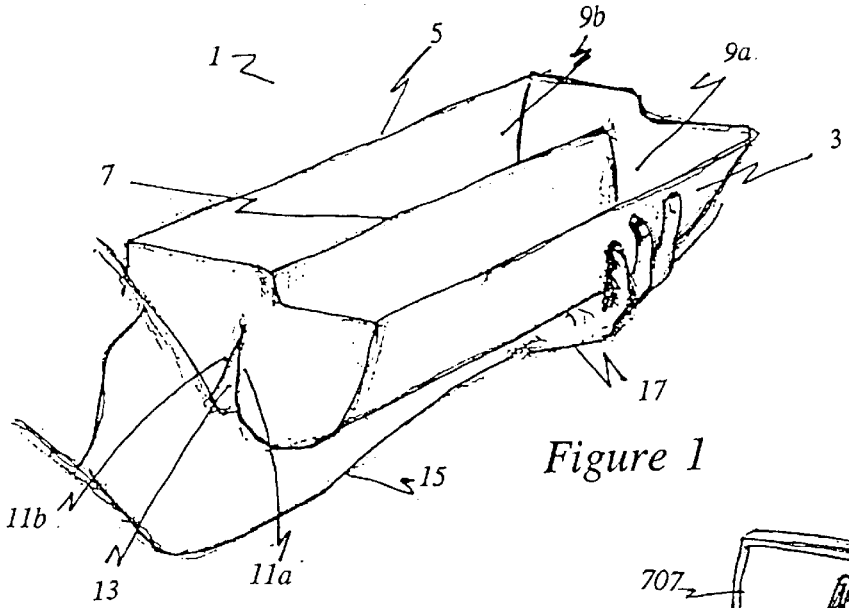
FIG. 1 is an isometric drawing of the preferred container of this invention being held on the forearm of a user.

Referring to FIG. 1, according to this invention a double bay container 1 is provided which is an open topped container having a first receptacle 3 and a second receptacle 5 joined at a common upper edge 7 each receptacle having a rectangular open top 9*a*, 9*b* and each receptacle enclosing a volume on all sides except the open top wherein the panels 11*a*, 11*b* extending from the common edge provide a sufficient space 13 therebetween to accommodate a portion of an extended forearm 15 and to accommodate at least a portion of a thumb of a hand 17 of a user extended beneath and around one of the receptacles.

Figure 2:
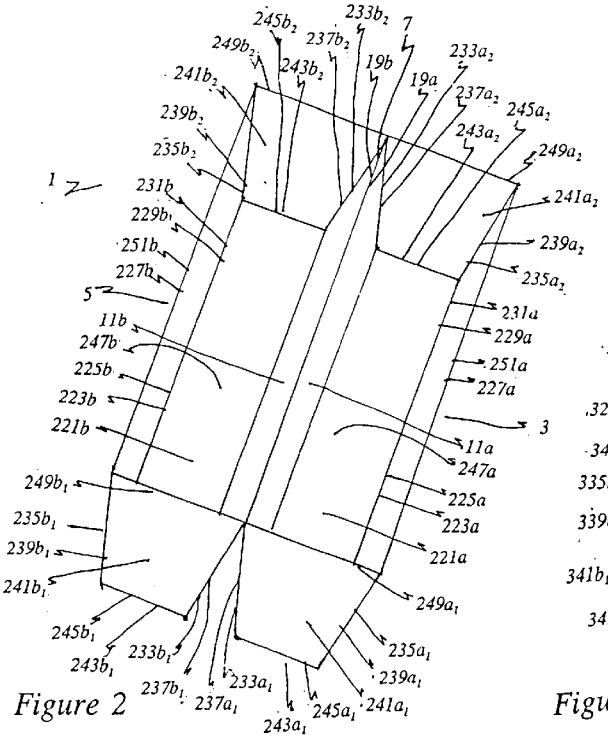
FIG. 2 is an isometric drawing of a first embodiment of the container of this invention.

Referring now to FIG. 2, according to a first embodiment of this invention, the open topped container 1 can have a first receptacle 3 that is a parallelepiped with a first rectangular panel 11*a* having the common edge 7 as its first longer edge 219*a*, a second rectangular panel 221*a* joined at its first longer edge 223*a* to the second longer edge 225*a* of the first rectangular panel, a third rectangular panel 227*a* joined at its first longer edge 229*a* to the second longer edge 231*a* of the second rectangular panel 221*a*, each of the first and third rectangular panels joined at each of its shorter edges 233$a_1$, 233$a_2$, 235$a_1$, 235$a_2$ to a non-parallel edge 237$a_1$, 237$a_2$, 239$a_1$, 239$a_2$ of a trapezoidal end piece 241$a_1$, 241$a_2$ and the second rectangular panel 221*a* joined at each of its shorter edges 243$a_1$, 243$a_2$ to the shorter of the parallel edges 245$a_1$, 245$a_2$ of a trapezoidal end piece 241$a_1$, 241$a_2$ thereby forming a container closed on five sides and having a rectangular opening 247*a* bordered by the common edge 7, the longer parallel edges 249$a_1$, 249$a_2$ of the trapezoidal end pieces and the second longer edge 251*a* of the third rectangular panel.

Similarly, the open topped container 1 can have a second receptacle 5 that is a parallelepiped that has a first rectangular panel 11*b* having the common edge 7 as its first longer edge 219*b*, a second rectangular panel 221*b* joined at its first longer edge 223*b* to the second longer edge 225*b* of the first rectangular panel, a third rectangular panel 227*b* joined at its first longer edge 229*b* to the second longer edge 231*b* of the second rectangular panel 223*b*, each of the first and third rectangular panels joined at each of its shorter edges 233$b_1$, 233$b_2$, 235$b_1$, 235$b_2$ to a non-parallel edge 237$b_1$, 237$b_2$, 239$b_1$, 239$b_2$ of a trapezoidal end piece 241$b_1$, 241$b_2$ and the second rectangular panel 221*b* joined at each of its shorter edges 243$b_1$, 243$b_2$ to the shorter of the parallel edges 245$b_1$, 245$b_2$ of a trapezoidal end piece 241$b_1$, 241$b_2$ thereby forming a container closed on five sides and having a rectangular opening 247*b* bordered by the common edge 7, the longer parallel edges 249$b_1$, 249$b_2$ of the trapezoidal end pieces and the second longer edge 251*b* of the third rectangular panel.

Figure 3:
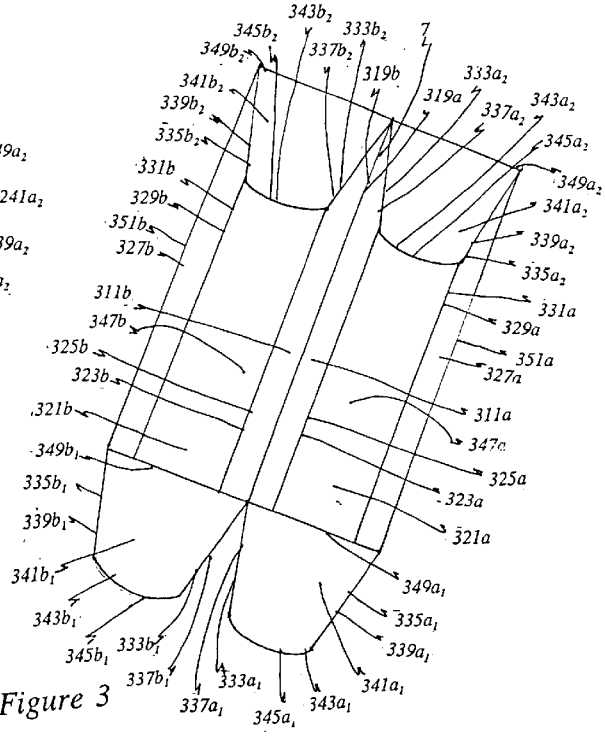
FIG. 3 is an isometric drawing of a second embodiment of the container of this invention.

Referring now to FIG. 3, according to a second embodiment of the invention, the open topped container 1 can have a first receptacle 3 which has a first rectangular panel 311*a* having the common edge 7 as its first longer edge 319*a*, a second rectangular panel 321*a* joined at its first longer edge 323*a* to the second longer edge 325*a* of the first rectangular panel and of equal length therewith, a third rectangular panel 327*a* joined at its first longer edge 329*a* to the second longer edge 331*a* of the second rectangular panel 321*a* and of equal length therewith, each of the first and third rectangular panels joined at each of its shorter edges 333$a_1$, 333$a_2$, 335$a_1$, 335$a_2$, to a first edge 337$a_1$, 337$a_2$ and third edge 339$a_1$, 339$a_2$, respectively, of an end piece 341$a_1$, 341$a_2$ and the second rectangular panel 321*a* joined at each of its shorter edges 343$a_1$, 343$a_2$ to the second edges 345$a_1$, 345$a_2$ of the end pieces. The second edges 345$a_1$, 345$a_2$ a of the end pieces 341$a_1$, 341$a_2$ can be curved and the second rectangular panel 321*a* can be bowed so that the shorter edges 343$a_1$, 343$a_2$ of the second rectangular panel 321*a* match the curve of the second edges of the end pieces thereby forming an integral container closed on five sides and having a rectangular opening 347*a* bordered by the common edge 7, the fourth edges 349$a_1$, 349$a_2$ of the end pieces and the second longer edge 351*a* of the third rectangular panel.

Similarly, the open topped container 1 can have a second receptacle 5 has a first rectangular panel which has a first rectangular panel 311*b* having the common edge 7 as its first longer edge 319*b*, a second rectangular panel 321*b* joined at its first longer edge 323*b* to the second longer edge 325*b* of the first rectangular panel and of equal length therewith, a third rectangular panel 327*b* joined at its first longer edge 329*b* to the second longer edge 331*b* of the second rectangular panel 321*b* and of equal length therewith, each of the first and third rectangular panels joined at each of its shorter edges 333$b_1$, 333$b_2$, 335$b_1$, 335$b_2$,to a first edge 337$b_1$, 337$b_2$ and third edge 339$b_1$, 339$b_2$, respectively, of an end piece 341$b_1$, 341$b_2$ and the second rectangular panel 321*b* joined at each of its shorter edges 343$b_1$, 343$b_2$ to the second edges 345$b_1$, 345$b_2$ of the end pieces. The second edges 345$b_1$, 345$b_2$ a of the end pieces 341$b_1$, 341$b_2$ can be curved and the second rectangular panel 327*b* can be bowed so that the shorter edges 343$b_1$, 343$b_2$ of the second rectangular panel 321*b* match the curve of the second edges of the end pieces thereby forming an integral container closed on five sides and having a rectangular opening 347*b* bordered by the common edge 7, the fourth edges 349$b_1$, 349$b_2$ of the end pieces and the second longer edge 351*b* of the third rectangular panel.

Figure 4:
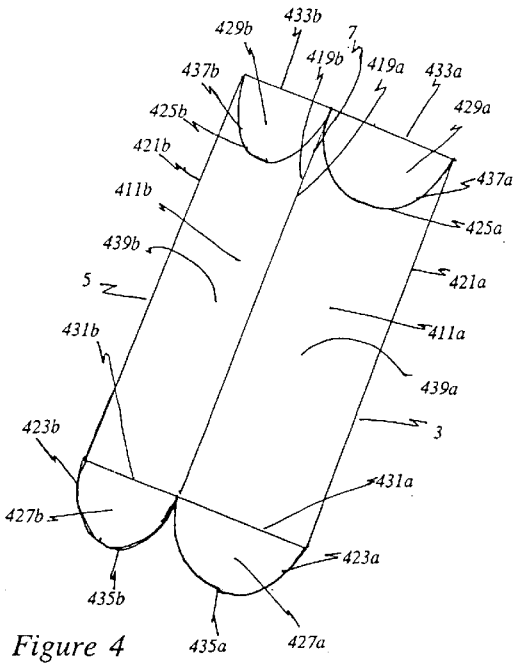
FIG. 4 is an isometric drawing of a third embodiment of the container of this invention.

Referring now to FIG. 4, according to a third embodiment of the invention, the open topped container 1 can have a first receptacle 3 which has a rectangular panel 411*a* having the common edge 7 as its first longer edge 419*a* and having this rectangular panel bowed in a smooth curve to form half of a cylinder that terminates in a second longer edge 421*a* and having each of its shorter edges 423*a*, 425*a* bowed in a smooth curve to form half a circle. The contained volume is enclosed at the shorter edges of the bowed, rectangular panel by end pieces 427*a*, 429*a* that have one straight edge 431*a*, 433*a* with the remainder of the edges 435*a*, 437*a* conforming to the smooth curve of the shorter edges of the bowed rectangular panel forming thereby an integral container defining a volume and having a rectangular opening 439*a* bordered by the common edge 7, the straight edges 431*a*, 433*a* of the end pieces and the second longer edge 421*a* of the rectangular panel.

Similarly, the open topped container 1 can have a second receptacle 3 which has a rectangular panel 411*b* having the common edge 7 as its first longer edge 419*b* and having this rectangular panel bowed in a smooth curve to form a parabolic sheet that terminates in a second longer edge 421*b* and having each of its shorter edges 423*b*, 425*b* bowed in a smooth curve to form a parabola. The contained volume is enclosed at the shorter edges of the bowed, rectangular panel by end pieces 427*b*, 429*b* that have one straight edge 431*b*, 433*b* with the remainder of the edges 435*b*, 437*b* conforming to the smooth curve of the shorter edges of the bowed rectangular panel forming thereby an integral container defining a volume and having a rectangular opening 439*b* bordered by the common edge 7, the straight edges 431*b*, 433*b* of the end pieces and the second longer edge 421*b* of the rectangular panel.

In the interest of brevity of illustration, FIG. 2 illustrates both the first and second receptacles as having trapezoidal end pieces, FIG. 3 illustrates both the first and second receptacles as having trapezoidal end pieces with curved shorter parallel sides and FIG. 4 illustrates the first receptacle as having a circular curvature and the second receptacle as having a parabolic curvature. It should be noted that the double bay container can have individual receptacles of any shape, those illustrated above or others, to define the enclosed volume of each receptacle so that, as an example, the container can have a first receptacle with end pieces having circular curvature, parabolic curvature or trapezoidal end pieces which can be paired with a second receptacle having end pieces different from those of the first receptacle.

The receptacles, however, must have a rectangular opening of sufficient size to accommodate applicator tools used with the container and, thereby, will have a common edge between the receptacles that is of sufficient length that the base of the container rests on the forearm of a user with the user's hand wrapped around the base of the receptacle that lies on the inside of the forearm. Preferably the common edge is of sufficient length that, in use, one end of the container can be pressed against the upper arm to steady and further support the container in operating condition. Since the commonly used applicators have a blade length of from about 4 to about 12 inches the practical limitation of length of common edge is in the range of up to about 16 inches, preferably from about 6 to about 15 inches to allow comfortable manipulation on the length of an average forearm. The only actual limitation is being too long to rest comfortably on the forearm.

The two receptacles can have the same or different widths. The limitations on the widths is dictated by practicality. Preferably, the width of the receptacle that is held by the user's hand is up to about 5 inches in width. This allows for a comfortable grip by the average hand. As stated above, the receptacle held by the user's hand is always the receptacle on the inside of the forearm so that the container can rest on the hand and forearm. The user, whether right or left handed, works with the applicator in this receptacle, scraping material in the receptacle toward the common edge to load the applicator. The second receptacle receives excess material that falls over the common edge and, therefore, does not have to be as wide as the working receptacle. The receptacle on the outside of the forearm can have a width of up to about an inch less than the receptacle on the inside of the forearm, but with a minimum width of about 4 inches dictated by ease of removing material collected therein.

Although a pair of receptacles, having any conformation of either of the receptacles, is appropriate for this invention, it is preferred that one of the receptacles, the working receptacle—the receptacle held on the inside of the forearm—have a smoothly curved path for raking the material onto the applicator. It is, therefore, preferred that this receptacle have end pieces shaped without angles of less than 180 degrees between the rectangular panels. The receptacles preferably will have end pieces described above as having edges than define a semicircle, a parabola or a second edge that is curved or bowed.

Figure 5:
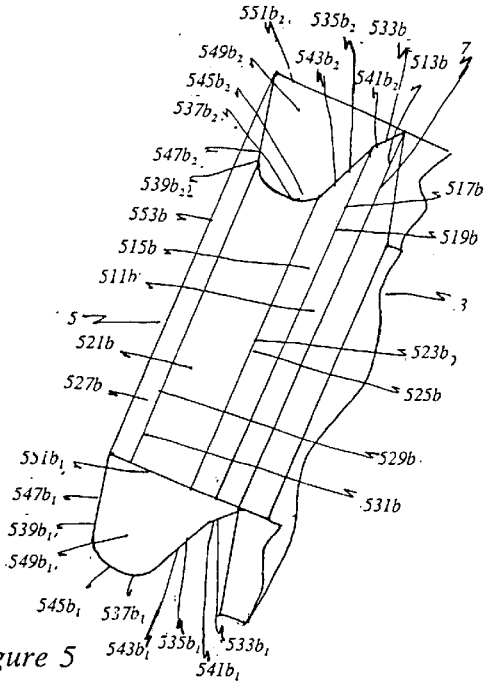
FIG. 5 is an isometric drawing featuring the preferred embodiment of the second receptacle of the container of this invention.

In the presently preferred embodiment of this invention, set out in FIG. 5, the second receptacle 5 has a first rectangular panel 511*b* having the common edge 7 with the first receptacle 3 as its first longer edge 513*b*, a second rectangular panel 515*b* joined at its first longer edge 517*b* to the second longer edge 519*b* of the first rectangular panel 511*b* and of equal length therewith, a third rectangular panel 521*b* joined at its first longer edge 523*b* to the second longer edge 525*b* of the second rectangular panel 515*b* and of equal length therewith, a fourth rectangular panel 527*b* joined at its first longer edge 529*b* to the second longer edge 531*b* of the fourth rectangular panel 527*b* and of equal length therewith, each of the first, second, third and fourth rectangular panels joined at each of its shorter edges 533$b_1$, 533$b_2$, 535$b_1$, 535$b_2$, 537$b_1$, 537$b_2$, 539$b_1$, 539$b_2$ to a first, second, third and fourth edge 531$b_1$, 531$b_2$, 533$b_1$, 533$b_2$, 535$b_1$, 535$b_2$, 537$b_1$, 537$b_2$ to respectively, of an end piece 539$b_1$, 539$b_2$ further wherein the first edges 541$b_1$, 54l$b_2$ of the end pieces are no more than half as long as the second edges 535$b_1$, 535$b_2$ of the end pieces and forms an external obtuse angle therewith, the third edge 537$b_1$, 537$b_2$ of the end pieces is curved and the third rectangular panel 521*b* is bowed so that the shorter edges of the third rectangular panel match the curve of the third edge 537$b_1$, 537$b_2$ of the end pieces thereby forming an integral container enclosed by four panels and two end pieces and having a rectangular opening bordered by the common edge 7, the fifth edge 551$b_1$,551$b_2$ of the end pieces and the second longer edge 553*b* of the fourth rectangular panel 527*b*.

This configuration is preferred because it allows a greater space between the bases of the receptacles for resting on the forearm and also allows more room for the thumb as it grasps the receptacle from which the working material is taken.

Any of the first receptacles described above can be fitted with a means for stabilizing the hand that grasps the receptacle when the container is being used. Such means, among others, can be chosen from roughened areas of the surface of the first receptacle, means for attaching to the bottom of the receptacle a rod that can be grasped with the hand and means for attaching to the bottom of the receptacle a strap that the hand can be placed through (remembering that since the container can be held in either hand both ends of the receptacle are equipped with the stabilizing means). Since one end of the receptacle should be kept clear to rest on the forearm, an attachment means can be installed in a grooved track constructed along the length of the bottom of the receptacle so that the attachment can slide along the bottom of the receptacle to the most favorable position for use.

Any of the pairs of receptacles for the containers which have been set out above can be produced with the edges of the receptacles that form the opening all lying in the same plane so that the top of the containers can lie flat on a surface when the container in inverted, as when it has been washed and is set to drain. The containers can be manufactured, however, so that a splash guard is supplied for the receptacle into which the excess material falls. As shown in is FIG. 7, preferably, in the second receptacle the longer edge of the second receptacle along with the longer edges of a trapezoidal end piece, the straight edge of an end piece having circular or parabolic edges or the fifth edge of the end piece of the preferred embodiment of the second receptacle and in the first receptacle at least a portion of the longer edges of a trapezoidal end piece and the straight edge of an end piece having circular or parabolic edges can be extended for a sufficient distance above this plane to provide means for retaining the material as it is scraped across the common edge of the receptacles of the container.

On their undersides each of the receptacles of the container, most preferable, extend an equal distance from the common edge so that the container can sit level on a flat surface. The distance between the first and second receptacles on the underside of the container allows not only for resting easily on a forearm, but also for resting on a rounded rung of a ladder.

The containers of this invention can be constructed of any material that is practicably light weight and durable. Metals, processed paper, wood and plastics, among others, are all suitable, with plastics, particularly moldable plastics preferred, because of their cost, availability and ease of processing.

Figure 6:
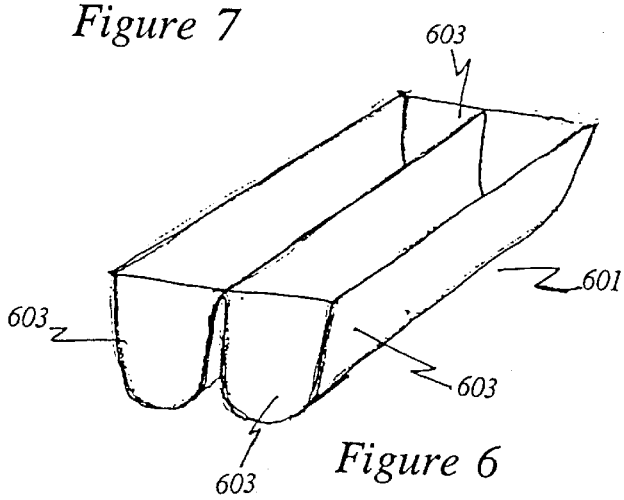
FIG. 6 is an isometric drawing of a unitary liner for the container of this invention.

As shown in FIG. 6, when the containers are constructed of less durable material their usability can be extended by the use of a metal insert or liner in the receptacles. The metal insert 601, preferably of thin tin plate or thin stainless steel plate, protects the container and allows the container to be constructed of a cheaper material for its overall strength while the metal liner provides a surface that is not as easily marred and is, therefore, easier to keep clean. Such a liner can be fabricated in one piece with the outer surface 603 conforming to the inner surfaces of the container receptacles, covering all interior surfaces and nestable in the interior of the container.

Figure 7:
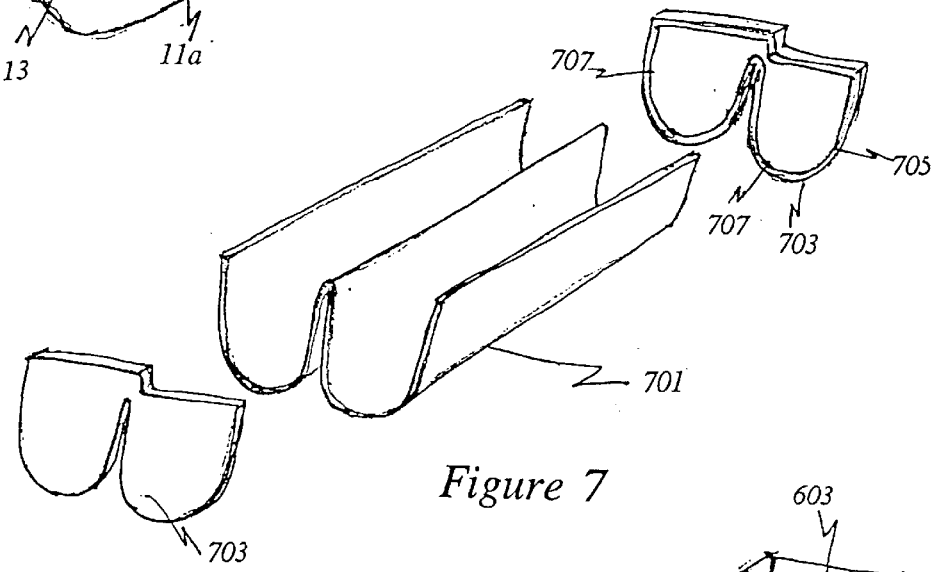
FIG. 7 is an isometric drawing of a three part liner for the container of this invention.

Referring to FIG. 7, the liner can also be made in multiple parts with a first piece 701 conforming to the entire portion of the inner surfaces of the container excluding the end pieces. A separate, second piece 703 and third piece 705 of the liner conforms to each of the end pieces with each end piece provided with a means for attachment to the first piece. Preferably, the end pieces contain a groove 707 sized with sufficiently small tolerances that the ends of the first piece can be inserted into the groove and will be held there or the groove can be fitted with rubbery gasket material that will hold the inserted ends of the first piece. The multiple part liner is sized to nest in the interior of the container sufficiently tightly that the pressure of the container ends will help to maintain the unity of the pieces of the liner. The first piece of the multiple part liner is made of metal, preferably thin plate of tin or steel. The end pieces, since they will not receive the abrasion of the applicator, can be made of metal, plastic, wood or even processed paper, among others.

The invention thus being described, it will be obvious that the invention can be varied in many ways. Such variations are not to be regarded as a departure from the spirit and scope of the invention and all such modifications are intended to be included within the scope of the following claims.

That which is claimed is:

1. An open topped container comprising a first receptacle and a second receptacle joined at a common upper edge each receptacle having a rectangular open top and each receptacle enclosing a volume on all sides except the open top wherein the panels extending from the common edge provide a sufficient space therebetween to rest on at least a portion of an extended forearm and accommodate a portion of a thumb of a hand of a user extended beneath and around one of the receptacles and wherein the second receptacle, which is on the outside of the forearm as the container rests on the forearm, further comprises a first rectangular panel having the common edge as its first longer edge, a second rectangular panel joined at its first longer edge to the second longer edge of the first rectangular panel and of equal length therewith, a third rectangular panel joined at its first longer edge to the second longer edge of the second rectangular panel and of equal length therewith, a fourth rectangular panel joined at its first longer edge to the second longer edge of the third rectangular panel and of equal length therewith, each of the first, second, third and fourth rectangular panels joined at each of its shorter edges to a first, second, third and fourth edge, respectively, of an end piece further wherein the first edge of the end pieces is no more than half as long as the second edge of the end pieces and forms an internal obtuse angle therewith, the third edge of the end pieces is curved and the third rectangular panel is bowed so that the shorter edges of the third rectangular panel match the curve of the third edge of the end pieces and the fourth edge of the end pieces is of a length equivalent to the sum of the lengths of the first and second edges thereby forming an integral container closed on five sides and having a rectangular opening bordered by the common edge, a fifth edge of the end pieces and the second edge of the fourth rectangular panel.

2. An open topped container according to claim 1 wherein the first receptacle is a parallelepiped comprising a first rectangular panel having the common edge as its first longer edge, a second rectangular panel joined at its first longer edge to the second longer edge of the first rectangular panel, a third rectangular panel joined at its first longer edge to the second longer edge of the second rectangular panel, each of the first and third rectangular panels joined at each of its shorter edges to a non-parallel edge of a trapezoidal end piece and the second rectangular panel joined at each of its shorter edges to the shorter of the parallel edges of a trapezoidal end piece thereby forming a container closed on five sides and having a rectangular opening bordered by the common edge, the longer parallel edges of the trapezoidal end pieces and the second longer edge of the third rectangular panel.

3. An open topped container according to claim 1 constructed of a material chosen from the group consisting of metals, plastics, wood and paper products.

4. An open topped container according to claim 1 comprising a liner with the outer surface of the liner conforming to the inner surfaces of the container receptacles of the container wherein the liner covers all interior surfaces of the container and is nestable in the interior of the container.

5. An open topped container according to claim 4 wherein the liner is of unitary construction.

6. An open topped container according to claim 5 wherein the liner is constructed of a material chosen from the group consisting of metals and plastic.

7. An open topped container according to claim 1 comprising a liner wherein the liner comprises:

(A) a first piece covering all interior surfaces of the container except the end pieces;

(B) a second piece covering a first end piece of the interior surface of the container and equipped with a grooved means for attachment to one end of the first piece and (C) a third piece covering a second end of the interior surface of the container and equipped with a grooved means for attachment to the other end of the first piece.

8. An open topped container according to claim 7 wherein the first piece of the liner is constructed of a material chosen from the group consisting of metals and plastics and the second and third pieces are constructed of a material chosen from the group consisting of metals, plastics, wood and paper products.

* * * * *